US005717026A

United States Patent [19]

Ikimine et al.

[11] Patent Number: 5,717,026

[45] Date of Patent: Feb. 10, 1998

[54] POLYVINYL ALCOHOL-BASED FIBER AND METHOD OF MANUFACTURE

[75] Inventors: Toshiaki Ikimine; Isao Sakuragi; Juniti Yoshinaka, all of Okayama, Japan

[73] Assignee: Kuraray Co., Ltd., Kurashiki, Japan

[21] Appl. No.: 651,592

[22] Filed: May 22, 1996

[30] Foreign Application Priority Data

May 22, 1995 [JP] Japan ..... 7-122132

[51] Int. Cl.[6] ..... C08F 16/06

[52] U.S. Cl. ..... 525/56; 525/61; 525/340; 525/344; 525/346

[58] Field of Search ..... 525/56, 61, 340, 525/344, 346

[56] References Cited

U.S. PATENT DOCUMENTS

| | | | |
|---|---|---|---|
| 2,716,049 | 8/1955 | Latour | 525/56 X |
| 3,011,861 | 12/1961 | Tanabe et al. | 525/56 X |
| 3,068,061 | 12/1962 | Johnson et al. | 525/56 |
| 3,102,775 | 9/1963 | Seeger | 525/56 X |
| 3,105,058 | 9/1963 | Osugi et al. | 525/56 X |
| 3,167,604 | 1/1965 | Arakawa et al. | 525/56 X |
| 3,210,147 | 10/1965 | Johnson et al. | 525/56 X |
| 3,826,298 | 7/1974 | Tanaka et al. | 152/359 |
| 3,850,901 | 11/1974 | Tanaka et al. | 525/56 |
| 3,852,401 | 12/1974 | Suzuki et al. | 264/182 |
| 3,852,402 | 12/1974 | Tanaka et al. | 264/185 |
| 3,907,958 | 9/1975 | Tsuji et al. | 264/184 |
| 3,987,140 | 10/1976 | Mizobe et al. | 264/170 |
| 4,138,445 | 2/1979 | Nogi et al. | 264/185 X |
| 4,612,157 | 9/1986 | Genba et al. | 264/186 |
| 4,713,290 | 12/1987 | Kwon et al. | 525/56 X |
| 5,011,644 | 4/1991 | Haruta et al. | 264/184 |
| 5,133,916 | 7/1992 | Sano et al. | 525/56 X |
| 5,340,522 | 8/1994 | Taniguchi et al. | 525/56 X |
| 5,455,114 | 10/1995 | Ohmory et al. | 525/56 X |

FOREIGN PATENT DOCUMENTS

| | | |
|---|---|---|
| 59-130314 | 7/1984 | Japan . |
| 61-108711 | 5/1986 | Japan . |
| 1-156517 | 6/1989 | Japan . |
| 1-1207435 | 8/1989 | Japan . |
| 2 -84587 | 3/1990 | Japan . |
| 2 -133605 | 5/1990 | Japan . |
| 2-249705 | 10/1990 | Japan . |

*Primary Examiner*—Judy M. Reddick

*Attorney, Agent, or Firm*—Oblon, Spivak, McClelland, Maier & Neustadt, P.C.

[57] ABSTRACT

A polyvinyl alcohol-based fiber having a gel elastic modulus of $0.05\times10^{-3}$ to $8.0\times10^{-3}$ g/cm·dr, a hot water shrinkage (Wsr) of 10% or higher, and a strength of 3 g/d or higher.

6 Claims, No Drawings

POLYVINYL ALCOHOL-BASED FIBER AND METHOD OF MANUFACTURE

BACKGROUND OF THE INVENTION

1. Field of the Invention

The present invention relates to polyvinyl alcohol-based (PVA) fibers which have excellent fatigue resistance and are suitable for use in the reinforcement of rubber products, which are used at high temperatures for long periods of time, such as tires, hoses, and conveyor belts, and for plastics and cement. The invention also relates to the manufacture of the PVA fibers, as well as to oil brake hoses reinforced with this fiber.

2. Description of the Background

Conventionally, PVA fiber has been used widely as a fiber for industrial materials because its high strength and high modulus in comparison to polyamide, polyester, and polyacrylonitrile fibers.

The recently published Japanese Patent Provisional Publication No. Sho 59-130314 and Japanese Patent Provisional Publication No. Sho 61-108711 disclose methods of obtaining PVA fibers of improved high strength and modulus. However, PVA fiber having high fatigue resistance, which is a necessary property for some uses of the fibers, cannot be obtained by these methods.

Many recently published applications of PVA fibers require PVA fiber which exhibit improved fatigue resistance. Japanese Patent Provisional Publication No. Hei 1-156517, Japanese Patent Provisional Publication No. Hei 1-207435, Japanese Patent Publication No. Hei 2-133605, and Japanese Patent Provisional Publication No. Hei 2-84587 propose PVA fibers of improved fatigue resistance. In these publications, techniques are proposed which improve the fatigue resistance of rubber products by cross-linking PVA fiber with epoxy compounds, isocyanate compounds, organic peroxides, carboxylic acid, phosphoric acid, and hydrochloric acid.

The present inventors have now tested these techniques to confirm the effect of these techniques and have concluded that the techniques, in which PVA fiber, cross-linked with a cross-linking agent, when subjected to dry heat drawing or PVA fiber, subjected to dry heat drawing, having a cross-linking agent applied thereto, followed by drying and heat treatment, do not result in PVA fiber having sufficient fatigue resistance. In detail, PVA fiber normally has hydrophilic hydroxyl groups in its molecular structure. Because of the presence of these groups, PVA fiber is generally wettable. However, high ratio drawing causes changes in orientation of the hydroxyl groups on the surface of PVA fiber from the outside to the inside of the fibers depending on the drawing ratio. As a result, PVA fiber tends to become more hydrophobic. Consequently, the cross-linking agent solution is not accepted evenly on the surface of fiber. Thus, although some portions of the fiber, where PVA is cross-linked sufficiently, exhibit excellent fatigue resistance, other portions are poorly fatigue resistant, and the overall fatigue resistance of the fiber is insufficiently improved.

According to these methods, relatively sufficient cross-links are formed on the surface layer of fiber, but cross-linking does not penetrate to the center of the fiber. Therefore, the central portion of the fiber remains poorly fatigue resistant, and the overall fatigue property of the fiber is not sufficiently improved.

Japanese Patent Provisional Publication No. Hei 2-249705 discloses a technique for improvement of the fatigue resistance of PVA fiber, which is used as a reinforcing cord for pneumatic tires in which cord of PVA fiber, the fiber is subjected to a post-treatment with cross-linking agent to form a cross-linked structure on the surface of the fiber. Otherwise, cross-linking agent is added to a spinning dope or spinning bath to allow penetration to the interior of the fiber. PVA is then cross-linked.

However, the cross-linking agent, added to the spinning dope, escapes to the spinning bath, under which conditions a sufficiently cross-linked structure does not form at the center of the fiber, because the spinning bath desolvates the spinning dope. Thus, both methods cannot contribute to a significant improvement in fatigue resistance. A need therefore continues to exist for a method of producing PVA fibers which is highly productive, and which produces fibers having high strength and excellent fatigue resistance.

SUMMARY OF THE INVENTION

Accordingly, one object of the present invention is to provide a method for manufacturing PVA fiber with high productivity, the fibers having a high fiber strength and excellent fatigue resistance.

Another object of the invention is to provide PVA fibers which are suitable as industrial material for reinforcing rubber products which are used under high temperature conditions, plastics and cement, and which is suitable for the manufacture of oil brake hoses which are reinforced with the present fiber.

Briefly, these objects and other objects of the present invention as hereinafter will become more readily apparent can be attained by a polyvinyl alcohol-based fiber which has a gel elastic modulus of $0.05\times10^{-3}$ to $8.0\times10^{-3}$ g/cm.dr, a hot water shrinkage (Wsr) of 10% or higher, and a strength of 6 g/d or higher.

Another aspect of the invention is a method for manufacturing polyvinyl alcohol-based fiber by dry spinning a solution of polyvinyl alcohol-based polymer containing 0.025 to 0.4% by weight of ammonium sulfate, based on the polyvinyl alcohol based polymer, drying the fiber, drawing the resulting fiber at a drawing temperature of at least 100° C. and lower than 210° C. at a drawing tension of at least 0.7 g/d and at a draw ratio of at least 7 and under the condition of $3.25 \leqq \log X - \log T \leqq 3.45$, wherein X represents the degree of polymerization of the polymer and T represents the residence time in a drawing furnace, and then heat treating the fiber at a temperature of at least 210° C. to introduce crosslinking into the fiber.

Still another aspect of the invention is a method of manufacturing a polyvinyl alcohol based fiber by dry spinning a solution of a polyvinyl alcohol-based polymer containing ammonium sulfate and ammonium phosphate, wherein ammonium sulfate and ammonium phosphate are present in a ratio of from 50:50 to 80:20 by weight and the total amount of ammonium sulfate and ammonium phosphate is 0.05 to 0.5% by weight, drying the fiber, drawing the resulting fiber at a drawing temperature of at least 100° C. and lower than 210° C. at a drawing tension of at least 0.7 g/d and a draw ratio of at least 7 and under the condition of $3.25 \leqq \log X - \log T \leqq 3.45$, wherein X represents the degree of polymerization of the polymer and T represents the residence time in a drawing furnace, and then heat treating the fiber at a temperature of at least 210° C. to crosslink the fiber.

DETAILED DESCRIPTION OF THE PREFERRED EMBODIMENTS

In order to impart fatigue resistance to PVA fiber, it is necessary to cross-link the amorphous region, where breaking of fiber structure concentrates, when subjected to fatigue. The numerical expression of degree of cross-linking is the gel elastic modulus. (The procedure for measuring the gel elastic modulus is described hereinafter.)

An aqueous solution of zinc chloride is a strong solvent for PVA and dissolves PVA fiber easily. If PVA molecules are cross-linked, crystallites of PVA are dissolved in an aqueous solution of zinc chloride. However, the fiber does not dissolve overall, because of the network of cross-linking and shrinks to form a gel. The extension behavior of the gel, responding to a tensile stress, follows Hook's law. The gel elastic modulus specified in the present invention is equivalent to the spring constant.

The gel elastic modulus of PVA fiber in accordance with the present invention is $0.05\times10^{-3}$ to $8.0\times10^{-3}$ g/cm·dr, preferably $0.1\times10^{-3}$ to $4.0\times10^{-3}$ g/cm·dr, more preferably $0.4\times10^{-3}$ to $3.0\times10^{-3}$ g/cm·dr.

Excessively low gel elastic modulus values result in a fiber of insufficient fatigue resistance, because of insufficient forming of a cross-linked structure, and excessively high gel elastic modulus values result in reduced tensile strength and fatigue resistance of the fiber because of reduced drawability and reduced molecular motion respectively.

It is necessary that a cross-linked structure be formed throughout the interior of the present fiber, with the distribution of cross-linking being expressed numerically by hot water shrinkage (referred to as Wsr hereinafter). A PVA fiber is hung with a very small weight on the bottom end and dipped in boiling water. Then, the amorphous region of he fiber swells and shrinks (Wsr is represented by shrinkage (%)). The very small weight at the end of the fiber is a weight, for example, of 2 mg/d.)

The hot water shrinkage (Wsr) varies, depending on the degree and distribution of cross-linking. Many conditions such as the content of cross-linking agent and temperature, time, and ratio of dry heat drawing are involved. The Wsr must be 10% or larger. Excessively small Wsr values result in insufficient fatigue resistance, because the interior of the fiber is insufficiently cross-linked. For fibers having excellent fiber properties the Wsr is 50% or larger and 85% or smaller, more preferably 65% or larger and 80% or smaller.

The PVA fiber of the present invention has a Wsr value as high as 10% or larger, because the cross-linking is distributed throughout the interior of the fiber, though the fiber is drawn and heated sufficiently. Even a fiber with a large a Wsr value has no problem in practical use and exhibits excellent performance as a reinforcing material, because the shrinkage stress level is very low.

Conventional well known PVA fibers are manufactured through sufficient drawing and heat treatment, and have a sufficient molecular orientation and high crystallinity, and therefore have Wsr values as small as 4.5% or smaller. Conventional PVA fibers are featured by having high fatigue resistance, but have Wsr values as small as 5% or smaller, because the cross-linking is distributed only on the surface of the fibers. In the event that cross-linking does not form sufficiently at the center of the fiber, the amorphous region dissolves before the fiber shrinks, which results in reduced shrinking stress and reduced hot water shrinkage.

Japanese Patent Provisional Publication No. Hei 5-263311 and Japanese Patent Provisional Publication No. Hei 5-163609 disclose a method of penetrating the cross-linking reaction into the interior of PVA fiber. The methods described in these publications improve the penetration of cross-linking in comparison to other previous methods. In these improved methods, a solution of PVA is wet-spun to form what is called wet-spun raw fiber. A cross-linking agent, typically an aldehyde compound, penetrates into the interior of the wet-spun raw fiber, followed by a cross-linking reaction. However, actually, it is difficult for an aldehyde compound to penetrate into the interior of a fiber for the cross-linking reaction. In some cases, the fiber surface is excessively cross-linked with cross-linking agent, or otherwise, the interior of the fiber is not sufficiently cross-linked. Therefore, it is difficult to satisfy both specifications of the gel elastic modulus and hot water shrinkage.

As a PVA polymer useful for the fiber of the present invention, a PVA polymer having a viscosity-average degree of polymerization of 1000 to 5000, preferably 1500 to 3500 is used in view of cross-link formation and availability.

A PVA polymer containing vinyl monomer units, other than polyvinyl-alcohol units, such as ethylene monomer and itaconic acid monomer, in an amount of about 10 mol % or less, in the form of a copolymer, may be used. A PVA polymer having a saponification percentage of 98 mol % or higher is preferably used in order to achieve excellent fiber properties.

The manufacturing method employed in the present invention is one in which a spinning dope, having a cross-linking agent added thereto, is dry-spun, and the filaments obtained are subjected to dry heat drawing, followed by cross-linking. This method is efficient for fiber manufacture and described infra.

PVA polymer chips are washed with water, swelled in warm water, and dehydrated in a dehydrator. The dehydrated, water-containing chips are conditioned until the water content reaches a prescribed value.

A cross-linking agent may be added in any conditioning step. Thus, cross-linking agent may be added to the PVA water-containing chips when kneaded under heating conditions to prepare a dope. Alternatively, the cross-linking agent may be added in a step just before spinning in an extruder. In view of homogeneous distribution of cross-linking agent, the cross-linking agent is added preferably in a conditioning step.

The PVA concentration in the spinning dope is generally preferably 30 to 60% by weight, though it depends on the degree of polymerization of the polymer. The temperature of a spinning dope just before extrusion is preferably a temperature of 125° to 180° C., which temperature does not cause substantial decomposition of the cross-linking agent which is added to the spinning dope.

Ammonium sulfate is preferably used as the cross-linking agent. Ammonium sulfate becomes effective only after ammonia is released from the ammonium salt under high temperature heat treatment conditions. The cross-linking reaction is substantially suppressed during spinning and drawing. Therefore, a cross-linked structure is formed in the fiber after drawing, and a high strength fiber having a sufficiently interior cross-linked structure is obtained.

The fiber having an interior cross-linked structure is subjected only with difficulty to high ratio drawing. If such a fiber is drawn, with force, the internal structure of the fiber is broken and the fiber strength is seriously reduced. Therefore, to obtain a fiber having high strength, it is necessary to form a cross-linked structure after high ratio drawing. The use of ammonium sulfate as a cross-linking agent permits the realization of cross-link formation.

A fiber strength of 6 g/d or higher is required, preferably 8 g/d or higher. A fiber having low strength is not sufficiently effective as a reinforcing material. The fatigue resistance is 60% or higher, more preferably 80% or higher.

Ammonium sulfate is nearly neutral in the spinning dope. Therefore, upon use, it does not result in the corrosion of metal members such as extruders, the piping for spinning dope, and nozzle plates, unlike cross-linking agents such as hydrochloric acid and phosphoric acid. For this reason, ammonium sulfate is excellent, also from the view point of process adaptability.

Ammonium sulfate is added to PVA polymer in an amount of 0.025 to 0.4% by weight, preferably 0.05 to 0.3% by weight of the PVA polymer.

The degree of polymerization of PVA polymer is related closely to the cross-linking reaction. A low content of ammonium sulfate is sufficient for the formation of a cross-linked structure of a fiber which exhibits excellent fatigue resistance made of a PVA polymer having a high degree of polymerization, because of its long chain molecule. On the other hand, only a high content of cross-linking agent can result in a fiber having sufficient fatigue resistance for a PVA polymer having a low degree of polymerization. However, a high content of ammonium sulfate results in a difficult to control, cross-linking reaction rate.

A cross-linking agent other than ammonium sulfate may be used together with ammonium sulfate. Ammonium phosphate is especially preferred together with ammonium sulfate as a cross-linking agent. Ammonium phosphate becomes effective as a cross-linking agent only after ammonia is released from the ammonium salt under high temperature heat treatment conditions. It is nearly neutral in a spinning dope, and therefore, ammonium phosphate is effective in the same way as ammonium sulfate.

When ammonium phosphate is used solely as a cross-linking agent, it is necessary to use a high content of ammonium phosphate to form a sufficiently cross-linked structure, because the cross-linking reaction proceeds very slowly. In such situations, much ammonia is released, which causes the formation of bubbles in the fiber and can result in poor fiber properties.

As described hereinabove, ammonium phosphate is used preferably together with ammonium sulfate, especially in the situation where the drawability is seriously affected by the degree of cross-linking. Ammonium phosphate can be used effectively, because the cross-linking reaction proceeds slowly.

For example, for a PVA polymer having a degree of polymerization of 1000 or higher and 2500 or lower, the use of ammonium sulfate with ammonium phosphate in combination is especially effective.

For the view points of controlling the reaction rate and fiber property, the use of ammonium sulfate with ammonium phosphate in combination in a ratio, by weight, of 50:50 to 80:20, especially 55:45 to 70:30 is preferred. The total amount of both cross-linking agents is 0.05 to 0.5% by weight, preferably 0.1 to 0.4% by weight to the weight of PVA polymer from the view points of cross-linking reactivity and fiber properties.

Dry spinning is used as the spinning method for manufacturing the fiber. For spinning a dope containing a cross-linking agent, if wet spinning or dry-wet spinning is used, the cross-linking agent escapes into the coagulating bath or desolvation bath. This escape results in an insufficiently cross-linked interior structure of the fiber.

On the other hand, dry spinning is the method in which a spinning dope is extruded into a gaseous atmosphere such as air and water in the dope is removed by drying. Under these conditions, the cross-linking agent does not escape. The cross-linking agent remains in the surface layer and also in the interior of the fiber.

A spinning dope is dry-spun under the usual conditions. The spinning dope containing PVA polymer is extruded through a nozzle plate into a gaseous atmosphere. Air is used as the gaseous atmosphere. The temperature of the gaseous atmosphere is usually 60° to 90° C.

Filaments extruded from the nozzle plate are collected on the first roller, and dried as they are. For drying, the filaments travel through hot plates, hot rollers, or heated air zones. The filaments are preferably dried in a stepwise manner, for example, in the first step at a temperature of 80° to 95° C., in the second step at a temperature of 100° to 120° C., and in the third step at a temperature of 120° to 140° C. Applying such a stepwise drying prevents the filaments from sticking to each other under the drying conditions. The drying temperature is 200° C. or lower, preferably 140° C. or lower in order to suppress the cross-linking reaction.

The dried filaments are subjected to drawing in order to improve various properties of the fibers including strength, when, it is required to draw substantially without a cross-linking reaction.

If a cross-linked structure is formed before the drawing process or during the drawing process, not only can a high drawing ratio not be applied, resulting in insufficient strength, but also the filaments are drawn with the accompanying breaking of the cross-linked structure formed previously. This results in breaking of the filaments and fluffing during the drawing process.

In the present method, the drawing conditions are a drawing temperature of 100° C. or higher and lower than 210° C., a drawing tension of 0.7 g/d or higher, a draw ratio of 7 or higher and $3.25 \leqq \log X - \log T \leqq 3.45$ (wherein X represents the degree of polymerization and T represents the residence time in a drawing furnace).

The drawing temperature is 100° C. or higher and lower than 210° C., preferably 130° to 205° C. Excessively high drawing temperatures cause a cross-linking reaction, which means that it is difficult to conduct high ratio drawing without damage of fiber performance. On the other hand, excessively low drawing temperatures result in difficulty in high ratio drawing.

For heat drawing, heating under conditions in which undrawn filaments come into contact with a heater such as hot roller and heat plate, heating in a heating medium, heating in a hot air bath, and dielectric heating may be used.

The drawing tension is 0.7 g/d or higher, preferably 0.8 g/d or higher.

Excessively low drawing tension results in difficulty in completing the drawing within a short time, while a cross-linking reaction does not proceed.

The drawing ratio is 7 or higher, preferably 8 or higher, and more preferably 10 or higher. Excessively low drawing ratios result in insufficient fiber strength.

The drawability of the fiber has a close relationship with the degree of polymerization of PVA polymer. A high degree of polymerization requires the drawing condition of a long residence time and the temperature of the filaments is raised sufficiently for drawing. However, excessively long residence times in a drawing furnace for fiber containing a cross-linking agent result in difficulty of drawing, because a cross-linking reaction proceeds before heat drawing.

When a polymer having a low degree of polymerization is used, the formation of cross-linking significantly affects drawability, and short residence times in a furnace are required. A short residence time in a furnace is sufficient for drawing, because the drawability is high in comparison to a polymer having a high degree of polymerization.

From the description supra, it is clear that it is necessary to adjust the degree of polymerization of polymer and residence time in a drawing furnace T from the viewpoints of drawability and cross-linking of the PVA. Thus, (logX–logT) is 3.25 or larger and 3.45 or smaller, more preferably 3.30 or larger and 3.40 or smaller.

Outside the range of (logX–logT) specified in the present invention, if the residence time in a drawing furnace is excessively long for the degree of polymerization of the polymer, a cross-linked structure is formed before completion of the drawing which results in the difficulty of high ratio drawing. In addition, the internal structure of the fiber is destroyed which causes breaking of filaments during the drawing. On the other hand, if the residence time in a drawing furnace is too short for the degree of polymerization of the polymer, the filaments are subjected to drawing before the temperature of the filament is raised insufficiently thereby resulting in insufficient improvement in fiber performance. In addition, fluffing due to drawing filament breaking and single filament breaking can result.

The residence time in a drawing furnace herein means the time a fiber resides in the drawing furnace under a temperature which is lower than the cross-linking reaction starting temperature. In detail, the residence time is obtained by dividing the length (m) of the drawing furnace at a temperature lower than the cross-linking reaction starting temperature by the draw feeding speed (m/min).

The fiber is drawn under such conditions. The drawing is completed at a temperature just lower than the decomposition temperature of ammonium sulfate (lower than 210° C.). Then, the fiber is subjected to a heat treatment (draw heat temperature and/or un-drawn heat treatment and/or heat shrinking treatment) in a temperature range of 210° C. or higher, at which temperature ammonium sulfate decomposes and releases ammonia.

During heat treatment of the fiber under such conditions, ammonium sulfate (ammonium phosphate) present in the fiber decomposes to release ammonia. Residual inorganic salt induces a radical cross-linking reaction which involves dehydration of PVA polymer, thereby causing cross-linking of PVA polymer. An excessively low heat treatment temperature does not cause substantial decomposition of the cross-linking agent, but results in the failure of formation of a cross-linked structure. The heat treatment temperature is 250° C. or lower, preferably 240° C. or lower in view of the suppression of PVA decomposition.

The heat treatment may be any one of an undrawn heat treatment, a draw heat treatment, as a heat shrinking treatment, or a combination of several heat treatments.

Preferably, the drawing (non-cross-linked drawing) is preferably, substantially complete at a temperature lower than the temperature which initiates cross-linking. The percentage of non-cross-linked drawing is 70% or higher of the total draw ratio, and more preferably 80% or higher. Drawing slightly at a temperature higher than the cross-linking starting temperature results in greater improvement in the fiber performance.

For the cross-linked drawing, the heat treatment temperature is preferably 210° C. or higher, but should not exceed 240° C. The slight drawing in this temperature range is carried out without drawing obstruction, because of the existence of a cross-linked structure, and the fiber performance is further improved. The cross-linked drawing is preferably conducted stepwise (preferably two steps) using a higher temperature for the second drawing, especially in the two step drawing. The temperature for the second drawing is preferably 5° to 20° C. higher than that for the first drawing.

The total draw ratio is 7 or higher, preferably 9 or higher.

When non-cross-linked drawing and cross-linked drawing are carried out continuously, control of the heat treatment temperature and drawing tension is very important to prevent a decrease in drawing tension and drawing elongation of the filaments because of the active molecular motion of the drawn filaments, which results in reduced entanglement between molecules and also in slipping between polymer molecules. The drawing tension is 0.7 to 2 g/d for a yarn denier, preferably 0.8 to 1.8 g/d, and the drawing temperature is preferably 235° C. or lower.

The non-cross-linked fiber, which is subjected to drawing at a temperature lower than cross-linking starting temperature and/or the fiber subjected to cross-linked drawing, is preferably subjected to a setting heat treatment (heat shrinking treatment). The temperature for heat shrinking is preferably a temperature 1° to 10° C. higher than the maximum temperature if the heat drawing. Specifically, the treatment temperature is preferably 210° to 250° C. The available heat shrinkage is in the range of 0 to 2%. If the cross-linking reaction is not completed during heat drawing, the cross-linking reaction may be completed during the heat shrinking treatment. Optionally, the cross-linking reaction may be completed mainly during heat drawing treatment or the cross-linking reaction may be completed during heat shrinking treatment.

After the heat treated fiber is wound or without winding, the heat treated fiber is usually fed to an oiling process. In the process of the present invention, the oiling agent, containing an alkali compound, normally sodium hydroxide, is preferably used to neutralize and remove residual sulfuric acid and phosphoric acid from the fiber. However, alkali compounds alone cannot neutralize the ammonium salt. Instead, ammonium salt is reacted with formalin, and then, the liberated sulfuric acid and phosphoric acid are neutralized with sodium hydroxide, thereby, effectively neutralizing the fiber. Therefore, an oiling agent containing sodium hydroxide and formalin is preferably used. Various methods are conventionally used for applying an oiling agent to the fiber. The usual roller touching method is sufficient for such use.

The total denier of multi-filaments is not critical, but the total denier is preferably 100 to 8000 d, more preferably 500 to 3000 d. The monofilament denier is preferably 0.1 to 1000 d, more preferably 1 to 100 d.

According to the method described hereinabove, a PVA fiber having excellent fatigue resistance is obtained. Generally, as the cross-linking reaction proceeds, the strength of the obtained fiber decreases. However, a fiber having a yarn strength of 6 d/g or higher is obtained in the present invention. A fiber which satisfies the gel elastic modulus and hot water shrinkage specified in the present invention is obtained by applying the amount of cross-linking agent added to a spinning dope and the heat treatment temperature as described above.

The fiber obtained of the present invention can be used in various applications, particularly has excellent performance as reinforcing material of brake hose.

A brake hose may be manufactured by a known method. For example, a yarn of PVA fiber obtained by the method of the present invention is twisted, then, treated with a resorcinol-formalin-latex (RFL) adhesive solution followed by drying and heat treatment. The obtained cord is braided to make a reinforcing material, and a brake hose is manufactured using this reinforcing material.

Having generally described this invention, a further understanding can be obtained by reference to certain specific examples which are provided herein for purposes of illustration only and are not intended to be limiting unless otherwise specified.

[Strength g/d, Initial Elastic Modulus g/d]

Strength and initial elastic modulus were measured according to the JIS L-1013 method. (The distance between chucks was 25 cm, extension speed was 30 cm/min, and twelve repeated results were averaged.)

[Fatigue Resistance %]

Yarns of 1200 dr were twisted to prepare a cord of 1200 dr/1×2 with a twist of 20×20 t/10 cm. A fatigue test sample was prepared according to the JIS L-1017-1983 method (reference specification: 3.2.1-A). This sample was subjected to belt flex fatigue testing.

Using a pulley having a diameter of 25 mm, a sample was flexed repeatedly 30000 times at the temperature of 100° C. Strength retention relative to the strength before testing was calculated.

[Gel Elastic Modulus $E\times10^{-3}$]

A cross-linked sample yarn was loaded with an initial weight of 1 g, and placed in an aqueous solution of $ZnCl_2$ ($ZnCl_2$ concentration is 50% by weight) at 50° C. for 1 to 3 min to dissolve un-cross-linked portions. Then, after completion of shrinkage in the aqueous solution of $ZnCl_2$, the sample length $l_2$ was measured, and the weight was changed successively from 2 to 20 g. The sample length $l_2$ was measured in the aqueous solution of $ZnCl_2$ individually for the weights. A gradient was determined from a graph of a plot of loads and sample length. The gradient was divided by the yarn denier before treatment (D) in order to determine the gel elastic modulus. The gel elastic modulus was calculated according to the following equation.

$$E=W/(l_2-l_1)\times D\ (g/cm\cdot dr)$$

[Hot Water Shrinkage Wsr %]

On one end of a sample yarn, a weight of 1/500 g to yarn denier (2 mg per denier) was loaded. The sample yarn was hung in an open vessel filled with boiling water (100° C.) for 30 minutes. The shrinkage of the sample length was measured, and the sample length after shrinking was divided by the sample length before shrinkage in order to determine the hot water shrinkage.

[Content of Cross-Linking Agent]

An un-cross-linked fiber containing a cross-linking agent before drawing was analyzed to determine the amount of nitrogen using a micro-nitrogen analyzer and the content of cross-linking agent was calculated.

[EXAMPLE 1]

Water-containing granular chips consisting of completely saponified PVA having a degree of polymerization of 3300 (logX=3.52), had added thereto, 0.05% by weight, based on PVA, of ammonium sulfate as a cross-linking agent. This material was treated by an extruder to prepare a spinning dope.

The spinning dope was heated to 165° C. and extruded into air of 70° C. through a nozzle plate having 200 holes with a hole diameter of 0.1 mm. The material was dry spun, and the filaments were wound up by a winder at a speed of 160 m/min. Then, using a hot air bath of 205° C. (the length of the furnace was 24 m), under a condition of draw feeding speed of 18.0 m/min (logT=0.12), logX−logY=3.40, and drawing tension of 1.4 g/d, the filaments were drawn at a draw ratio of 9.5. The filaments were additionally subjected to the heat drawing bypassing the filaments through two hot air baths of 210° C. (6 m) and 230° C. (6 m) at a total draw ratio of 10.5. The filaments were then continuously subjected to heat shrinking treatment with a relaxation of 3% by passing the filaments through a heat treatment furnace, the internal temperature of which furnace was set to 245° C. (30 m). Thus, a fiber of 1200 dr/200 f was obtained. The results are shown in Table 1.

[EXAMPLE 2]

Water-containing granular chips consisting of completely saponified PVA having a degree of polymerization of 1700 (logX=3.23), had added thereto, 0.20% by weight, based on PVA, of a mixture of ammonium sulfate and ammonium phosphate as the cross-linking agent. The mixing ratio of ammonium sulfate and ammonium phosphate was 60:40. The material was treated in an extruder to prepare a spinning dope.

The dope was heated to 150° C., and extruded into air of 70° C. through a nozzle plate having 200 holes with a hole diameter of 0.1 mm. The material was dry spun, and the filaments were wound up by a winder at a speed of 160 m/min. Then, using a hot air bath of 195° C. (the length of the furnace was 24 m), under the conditions of a draw feeding speed of 32.4 m/min (logT=−0.13), logX−logY=3.36, and a drawing tension of 0.8 g/d, the filaments were drawn at a draw ratio of 10. The filaments were then additionally subjected to heat drawing by passing the filaments through two hot air baths of 210° C. (6 m) and 230° C. (6 m) at a total draw ratio of 11. The filaments were then continuously subjected to a heat shrinking treatment with a relaxation of 3%, by passing the filaments through a heat treatment furnace, the internal temperature of which furnace was set to 245° C. (30 m). Thus, a fiber of 1200 dr/200 f was obtained. The results are shown in Table 1.

[EXAMPLE 3]

Water-containing granular chips consisting of completely saponified PVA having a degree of polymerization of 2400 (logX=3.38), had added thereto, 0.20% by weight, based on PVA, of a mixture of ammonium sulfate and ammonium phosphate as the cross-linking agent. The mixing ratio of ammonium sulfate and ammonium phosphate was 55:45, and the material was treated in an extruder to prepare a spinning dope.

The dope was heated to 160° C., and then extruded into air of 70° C. through a nozzle plate having 200 holes with a hole diameter of 0.1 mm. That is the dope was dry spun, and the filaments were wound up by a winder at a speed of 160 m/min. Then, using a hot air bath of 205° C. (the length of the furnace was 24 m), under a condition of draw feeding speed of 23.4 m/min (logT=0.01), logX−logY=3.37, and a drawing tension of 1.1 g/d, the filaments were drawn at a draw ratio of 10. The filaments were additionally subjected to heat drawing by passage through two hot air baths of 210° C. (6 m) and 230° C. (6 m) at a total draw ratio of 11. The filaments were then continuously subjected to heat shrinking treatment with a relaxation of 3%, by passing the filaments through a heat treatment furnace, the internal temperature of which was set to 245° C. (30 m). Fibers of 1200 dr/200 f were obtained. The results are shown in Table 1.

[COMPARATIVE EXAMPLE 1]

Completely saponified PVA having a degree of polymerization of 1700 (logX=3.23) was treated in an extruder to prepare a spinning dope, and the dope was dry-spun to form undrawn filaments in the same manner as described in Example 1, except that a cross-linking agent was not added.

Then, using a hot air bath of 70° C. (the length of the furnace was 24 m), under a condition of a draw feeding speed of 32.4 m/min (logT=−0.13), logX−logY=3.36, and a drawing tension of 0.6 g/d, the filaments were drawn at a draw ratio of 10. The filaments were additionally subjected to heat drawing by passage through two hot air baths of 210° C. (6 m) and 230° C. (6 m) at a total draw ratio of 11, then continuously, subjected to a heat shrinking treatment with a relaxation of 3% by passage through a heat treatment furnace, the internal temperature of which was set to 245° C. (30 m). The filaments were wound up at a speed of 345.7 m/min. Fibers of 1200 dr/200 f were obtained. The results are shown in Table 1.

[COMPARATIVE EXAMPLE 2]

Ammonium sulfate and ammonium phosphate were mixed in a ratio 60:40 by weight, and the mixture was dissolved in water to prepare an aqueous solution of 2000 ppm concentration. The aqueous solution was applied to the fiber obtained in Comparative Example 1 followed by drying at 120° C. The fibers were continuously subjected to a heat treatment with a relaxation of 0% (fixed length) by passage through a heat treatment furnace, the internal temperature of which was set to 235° C. The results are shown in Table 1.

The obtained fibers were irregularly cross-linked and had poor tensile strength, initial modulus, and fatigue resistance.

[COMPARATIVE EXAMPLE 3]

Fiber prepared in the same manner as described in Example 2 were prepared except that 0.20% by weight, based on PVA, of ammonium phosphate was added to PVA as the cross-linking agent. The results are shown in Table 1.

[COMPARATIVE EXAMPLE 4]

Using completely saponified PVA having a degree of polymerization of 1700, a spinning dope was prepared and the dope was dry-spun in the same manner as described in Example 2, except that 0.20% by weight, based on PVA, of phosphoric acid was added as the cross-linking agent. However, extrusion failed because of an increase in the spinning pressure, which resulted from a cross-linking reaction in the dope. Spinning was impossible. To cope with this problem, the spinning temperature was lowered to 90° C., and the fiber was manufactured in the same manner as described in Example 2. However, the total draw ratio was only 7.1 and the yarn strength of the obtained fiber was as low as 2.8 g/dr, probably because of the cross-linked structure. The results are shown in Table 2.

[COMPARATIVE EXAMPLE 5]

Using completely saponified PVA having a degree of polymerization of 3300 (logX=3.52), spinning and drawing were carried out in the same manner as described in Example 1, except that 0.80% by weight, based on PVA, of ammonium sulfate was added as the cross-linking agent. However, fluffing occurred in the drawing process. The draw ratio was changed to 8, but, fluffing had not improved, and the fiber obtained had poor yarn property and yarn strength. The results are shown in Table 2.

[COMPARATIVE EXAMPLE 6]

Undrawn filaments obtained in the same manner as described in Example 2 were treated in the same manner as described in Example 2 except that a hot air bath of 195° C. (the length of the furnace was 24 m) was used, under the condition of a draw feeding speed of 24.0 m/min (logT=0.00), logX−logY=3.23, and a drawing tension of 0.8 g/d. The filaments were drawn at a draw ratio of 8. Drawing filament break was severe because of significant cross-linking. The fiber difficulty obtained exhibited poor performance. The results are shown in Table 2.

[COMPARATIVE EXAMPLE 7]

Undrawn filaments obtained in the same manner as described in Example 2 were treated in the same manner as described in Example 2, except that a hot air bath of 195° C. (the length of the furnace was 24 m) was used, under the condition of draw feeding speed of 37.0 m/min (logT=−0.19), logX−logY=3.42, and a drawing tension of 0.8 g/d. The filaments were drawn at a draw ratio of 11.

However, drawing filament break was severe because of insufficient heating for drawing, and the fiber, difficulty obtained exhibited poor performance. The results are shown in Table 2.

[COMPARATIVE EXAMPLE 8]

Spinning and drawing were carried out in the same manner as described in Example 2 except that the temperature of the hot air bath was changed from 195° C. to 218° C. (the length of the furnace was 24 m). However, the filaments were difficult to draw because of developed cross-linked structure during drawing. The results are shown in Table 2.

[COMPARATIVE EXAMPLE 9]

PVA having a degree of polymerization of 2400 was dissolved in dimethylsulfoxide (DMSO) at 90° C. to prepare a solution containing 12% by weight of PVA. A 0.15% by weight amount of a mixture of ammonium sulfate and ammonium phosphate mixed in a ratio of 60:40, based on PVA, was added as the cross-linking agent to prepare a spinning dope. The dope was dry-wet spun into a coagulation bath comprising a mixture of methanol and DMSO in a weight ratio of 7:3 at 5° C. through a nozzle having 80 holes. The filaments were wet-drawn with a draw ratio of 4 in a methanol bath at 40° C. followed by drying at 80° C. Analysis of the dried filaments resulted in no detected cross-linking agent. This fact suggested that the cross-linking agent escaped into the coagulation bath. The drawn filaments had poor fatigue resistance. The results are shown in Table 2.

TABLE 1

| | Example 1 | Example 2 | Example 3 | Comparative example 1 | Comparative example 2 | Comparative example 3 |
|---|---|---|---|---|---|---|
| Polymerization degree X | 3300 | 1700 | 2400 | 1700 | 1700 | 1700 |
| logX | 3.52 | 3.23 | 3.38 | 3.23 | 3.23 | 3.23 |
| Cross-linking agent | Ammonium sulfate | Ammonium sulfate/ ammonium phosphate | Ammonium sulfate ammonium phosphate | — | Ammonium sulfate/ ammonium phosphate | Ammonium phosphate |
| Mixing ratio of cross-linking agent | Used solely | 60:40 | 55:45 | 0 | 0.20 | Used solely |
| Method of adding cross-linking agent | Mixed spinning | Mixed spinning | Mixed spinning | No addition | After heat drawing | Mixed spinning |
| Residual time T (min) | 1.33 | 0.74 | 1.03 | 0.74 | — | 0.74 |
| logT | 0.12 | −0.13 | 0.01 | −0.13 | — | −0.13 |
| logX − logT | 3.40 | 3.36 | 3.37 | 3.36 | — | 3.36 |
| Draw ratio | 9.5 | 10.0 | 10.0 | 10.0 | — | 10.0 |
| Total draw ratio | 10.5 | 11.0 | 11.0 | 11.0 | — | 11.0 |
| Tensile strength | 9.3 | 9.8 | 9.6 | 9.7 | 7.5 | 9.2 |
| Tensile modulus | 238 | 222 | 238 | 225 | 200 | 228 |
| Fatigue resistance | 98 | 68 | 90 | 24 | 42 | 28 |
| Gel E × $10^{-3}$ | 1.5 | 0.5 | 0.8 | 0.0 | 0.1 | 0.0 |
| Wsr | 78 | 70 | 72 | 4.5 | 4.5 | 4.5 |

TABLE 2

| | Comparative example 4 | Comparative example 5 | Comparative example 6 | Comparative example 7 | Comparative example 8 | Comparative example 9 |
|---|---|---|---|---|---|---|
| Polymerization degree X | 1700 | 3300 | 1700 | 1700 | 1700 | 1700 |
| logX | 3.23 | 3.52 | 3.23 | 3.23 | 3.23 | 3.38 |
| Cross-linking agent | Phos-phoric acid | Ammonium sulfate | Ammonium sulfate/ ammonium phosphate | Ammonium sulfate/ ammonium phosphate | Ammonium sulfate/ ammonium phosphate | Ammonium sulphate/ ammonium phosphate |
| Mixing ratio of cross-linking agent | Used solely | Used solely | 60/40 | 60/40 | 60/40 | 60:40 |
| Method of adding cross-linking agent | Mixed spinning | Mixed spinning | Mixed spinning | Mixed spinning | Mixed spinning | Mixed spinning |
| Residual time T (min) | 0.74 | 01.33 | 1.00 | 0.58 | 0.74 | 1.03 |
| logT | −0.13 | −0.12 | 0.00 | −0.24 | −0.13 | 0.01 |
| logX − logT | 3.36 | 3.40 | 3.23 | 3.47 | 3.36 | 3.37 |
| Draw ratio | 6.4 | 8.0 | 8.0 | 10.0 | 1.5 | 11.0 |
| Total draw ratio | 7.1 | 9.0 | 9.0 | 11.0 | 1.7 | 12.5 |
| Tensile strength | 2.8 | 3.8 | 2.9 | 3.3 | 0.7 | 13.0 |
| Tensile modulus | 122 | 182 | 131 | 198 | 125 | 258 |
| Fatigue resistance | 42 | 53 | 45 | 40 | 62 | 36 |
| Gel E × $10^{-3}$ | 0.9 | 2.0 | 1.0 | 0.3 | 0.8 | 0.0 |
| Wsr | 85 | 95 | 87 | 68 | 75 | 3.5 |

EXAMPLE 4

PVA yarns (1200 d/200 f) obtained in Examples 1 to 3 were twisted to prepare cords with a twist of 90 turns/m. The cord was dipped in RFL described infra, followed by drying at 100° C. for 2 minutes. The cord was heat treated at 160° C. for 2 minutes (RFL pick up was 5%).

| (RFL solution recipe) | | |
|---|---|---|
| Solution A: | water | 300 parts by weight |
| | resorcinal | 11 parts by weight |
| | formaldehyde (37%) | 24 parts by weight |
| | aqueous solution of | 11 parts by weight |

-continued

| (RFL solution recipe) | | |
|---|---|---|
| sodium hydroxide (10%) | | |
| The above-mentioned A-solution was aged at 25° C. for 6 hr. | | |
| Solution B: | SBR latex | 130 parts by weight |
| vinylpyridine modified | SBR latex | 130 parts by weight |
| water | | 260 parts by weight |

The above-mentioned solution B was mixed with the aged solution A, and the mixture was aged at 25° C. for 16 hr.

(SBR is the abbreviation of styrene-butadiene rubber.)

SBR rubber was extruded on a mandrel with an outside diameter of 3.2 mm as the inner rubber layer, and a doubled cord of two treated cords of 1200 dr was braided with a carrier of 20 on the inner rubber layer as the first fiber reinforcing layer.

Next, a cushion rubber with a thickness of 0.2 mm (middle rubber layer) was wound. A tripled cord of three treated cords of 1200 dr was then braided with a carrier of 24 to form the second fiber reinforcing layer. Ethylenepropylene rubber was extruded to form the cover rubber layer (outside rubber layer) thereby forming a tube covered with the cover rubber layer.

The tube was then cured in a steam atmosphere at 150° C. The tube was cut to a length of 300 mm, and metal fittings were attached on both ends to make a hose. (outside diameter of the hose was 10.5 mm)

A hose was filled with Honda Co. genuine brake oil DOT-4. An impulse pressure of 0 to 100 kgf/cm$^2$, with a frequency of 70/min, was applied to the hose at 100° C. The number of impulse pressure repetitions until a hose had broken, resulting in leakage of the brake oil, was determined. It was found that the oil did not leak after subjection to 30,000 impulse pressure repetitions for all tested brake hoses.

The PVA fiber of the invention has excellent in strength, initial modulus, and fatigue resistance. The fiber is therefore useful in diverse applications such as a reinforcing material for rubber products such as oil brake hoses and conveyer belts, which are the typical applications of PVA fiber, and as a reinforcing material for cement and plastic products.

Using the present manufacturing method, PVA fiber having excellent strength, initial modulus, and fatigue resistance is manufactured at low cost and high productivity using commercially available PVA having a degree of polymerization of 1500 or higher and lower than 3000.

Having now fully described the invention, it will be apparent to one of ordinary skill in the art that many changes and modifications can be made thereto without departing from the spirit or scope of the invention as set forth herein.

What is claimed as new and intended to be secured by Letters Patent of the United States is:

1. A polyvinyl alcohol-based fiber having a gel elastic modulus of $0.05\times10^{-3}$ to $8.0\times10^{-3}$ g/cm·dr, a hot water shrinkage (Wsr) of 10% or higher, and a tensile strength of 6 g/d or higher.

2. The polyvinyl alcohol-based fiber of claim 1, wherein said gel elastic modulus ranges from $0.1\times10^{-3}$ to $4.0\times10^{-3}$ g/cm·dr, and said hot water shrinkage (Wsr) ranges from 50% to 85% tensile.

3. The polyvinyl alcohol-based fiber of claim 1, wherein said gel elastic modulus ranges from $2.4\times10^{-3}$ to $3.0\times10^{-3}$ g/cm·dr, the hot water shrinkage (Wsr) value ranges from 65% to 80% and the tensile strength is at least 8 g/d.

4. The polyvinyl alcohol-based fiber of claim 1, wherein the PVA polymer, from which the PVA-based fibers is prepared, has a viscosity-average degree of polymerization of 1,000 to 5,000.

5. The polyvinyl alcohol-based fiber of claim 4, wherein said viscosity-average degree of polymerization ranges from 1500 to 3500.

6. The polyvinyl alcohol-based fiber of claim 4, wherein said PVA polymer has a saponification degree of at least 98 mol %.

* * * * *